United States Patent [19]

Dibben

[11] 3,990,588

[45] Nov. 9, 1976

[54] BULK FLOW BELT FEEDER GATE WITH INTERLOCKED STRIKER PLATE

[75] Inventor: David W. Dibben, Belleville, Canada

[73] Assignee: Allis-Chalmers Canada, Limited, Lachine, Canada

[22] Filed: Dec. 22, 1975

[21] Appl. No.: 643,309

[52] U.S. Cl. ..... 214/15 D; 198/532; 198/540; 214/83.2

[51] Int. Cl.[2] ..... B63B 27/22

[58] Field of Search ..... 214/12, 14, 15 D; 198/56, 57, 58, 52, 53 R, 53 A, 54; 222/547

[56] References Cited

UNITED STATES PATENTS

| | | | |
|---|---|---|---|
| 3,191,998 | 6/1965 | Howlett | 214/15 D X |
| 3,489,296 | 1/1970 | Snow | 214/15 D |

*Primary Examiner*—Robert G. Sheridan
*Assistant Examiner*—George F. Abraham
*Attorney, Agent, or Firm*—Robert C. Sullivan

[57] ABSTRACT

A bulk flow belt feeder gate for discharging a bulk material such as mineral ore or the like from a ship hold or the like onto an unloading conveyor belt beneath the ship hold, and a cooperating striker plate positioned immediately contiguous the downstream end of the bulk flow belt feeder gate and interlocked with the gate, whereby the striker plate is automatically selectively movable into an operative or inoperative position in accordance with whether the bulk flow belt feeder gate is in open or closed position. When in a "down" or operative position corresponding to an open position of the bulk flow belt feeder gate, the striker plate controls the cross-sectional shape of the load of bulk material passing from beneath the associated bulk flow belt feeder gate onto the conveyor belt downstream of the given gate, the striker plate cooperating with the associated bulk flow belt feeder gate to provide what in effect is a material flow metering action which determines the tonnage of bulk material delivered by the belt conveyor per unit time. When in a raised or inoperative position, corresponding to a closed position of the associated bulk flow belt feeder gate, the striker plate is in noninterfering relation with respect to bulk material deposited on the conveyor by another bulk flow belt feeder gate upstream of the given gate.

18 Claims, 4 Drawing Figures

Fig. 1
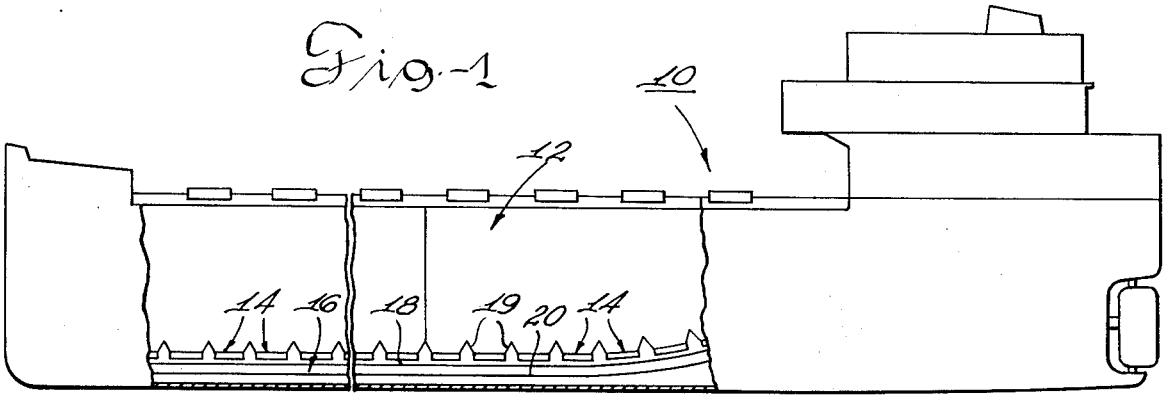
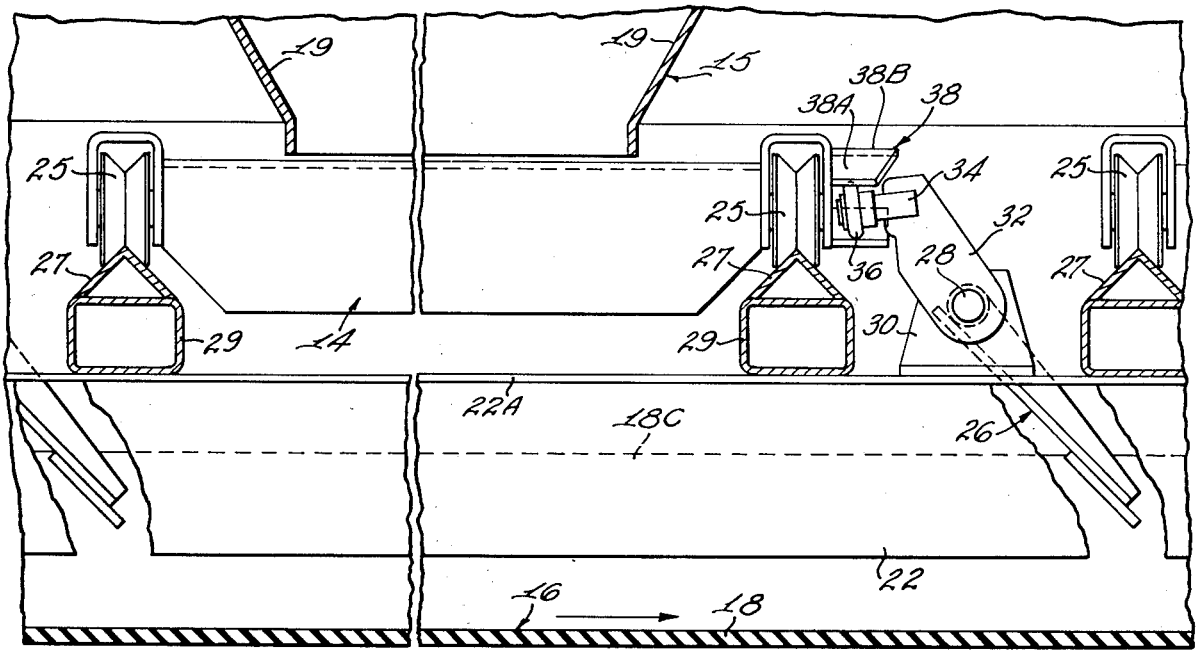
Fig. 3
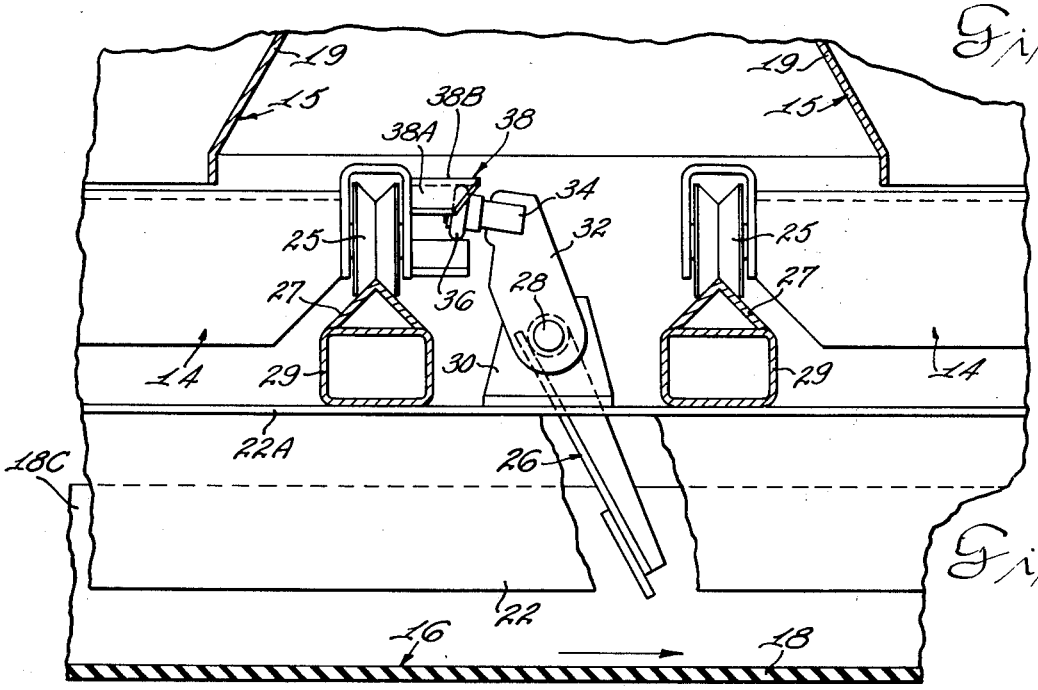
Fig. 4

BULK FLOW BELT FEEDER GATE WITH INTERLOCKED STRIKER PLATE

BACKGROUND OF THE INVENTION

1. Field of the Invention

This invention relates to ship unloading apparatus and more particularly to bulk flow belt feeder gates for discharging bulk material such as mineral ore or the like from a ship hold onto an unloading conveyor belt beneath the ship hold, and to the combination with such a bulk flow belt feeder gate of a striker plate whose position is coordinated with the open or closed position of the bulk flow belt feeder gate to control the cross-sectional shape of the load of bulk material passing from beneath a given gate onto the conveyor belt downstream of the given gate, the striker plate cooperating with the associated bulk flow belt feeder gate to provide what in effect is a bulk material flow metering action which determines the tonnage of bulk material delivered by the belt conveyor per unit time.

2. Description of the Prior Art

It has been known in the prior art to unload bulk material, such as mineral ore, for example, onto a conveyor belt from a stock pile in the hold of a ship through what is known as a "bulk flow belt feeder gate" at the lower end of the ship hold, the bulk material being unloaded through the bulk flow belt feeder gate onto an underlying conveyor belt which carries the material thus unloaded to a suitable discharge point of the conveyor system.

A "bulk flow belt feeder gate" as known in the prior art, and in the sense used in the present patent application, is a gate which underlies bulk material (such as mineral ore, etc.) in a ship hold or hopper, and which when opened, permits a substantially uncontrolled flow of the bulk material to drop from the hold or hopper onto an underlying conveyor belt. The "bulk flow belt feeder gate" is usually either fully open or fully closed and is not usually so constructed or arranged as to be in a partially open or partially closed condition to provide control of the flow of bulk material to the underlying belt.

In the prior art, a "striker plate" has always been associated with the bulk flow belt feeder gate, the purpose of the striker plate being to serve, in effect, as a template whose shape determines the cross-sectional contour of the load of material dragged out on the conveyor from the uncontrolled quantity of bulk material dropped onto the belt conveyor by the bulk flow feeder gate. Thus, the striker plate of the prior art and also of the present invention cooperates with the associated bulk flow belt feeder gate to provide what in effect is a bulk material flow metering action which determines the tonnage of bulk material delivered by the belt conveyor per unit time.

To the best of my knowledge, in the prior art, the striker plate has always been fixed in a "down" or operative position. Since the striker plate associated with the prior art bulk flow feeder gate was always in the "down" position, it was only practical to have one bulk flow belt feeder gate deposit bulk material onto a given conveyor, since a plurality of bulk flow belt feeder gates feeding a common conveyor belt with each gate having an associated striker plate in the conventional fixed "down" position would result in material deposited on the conveyor belt from a given bulk flow belt feeder gate being interfered with by the "down" position striker plates of bulk flow belt feeder gates feeding the same given conveyor and lying downstream of the given gate and in the path of movement of the bulk material deposited on the belt from the given gate.

For the reasons just given, in the prior art where it was desired to have several feed points onto a given conveyor, arrangements for loading the bulk material other than "bulk flow belt feeder gates" have been used, such as manually operated control gates which require an operator to regulate the flow from the gate to the belt, or other types of gates, such as vibrating gates, for example, which provide a controlled flow of the bulk material onto the belt. Such other alternatives are more expensive to operate or install than the bulk flow belt feeder gate. The bulk flow belt feeder gate has the advantage that it has few moving parts, requires very little head room, is relatively inexpensive, and, in conjunction with its associated striker plate, loads the belt to a desired cross-section automatically. However, as previously pointed out, it has only been practical in the prior art to use one bulk flow belt gate for a given conveyor belt.

OBJECTS OF THE INVENTION

Accordingly, it is an object of the present invention to provide a ship unloading apparatus comrising a bulk flow belt feeder gate for dispensing bulk material from a ship hold or the like onto a moving conveyor belt, and including a cooperating striker plate interrelated in its action with the open or closed position of the bulk flow belt feeder gate in such manner that the striker plate is automatically moved to an operative position to define the cross-sectional contour of the bulk load dragged along the conveyor belt from the load deposited on the conveyor belt when the bulk flow belt feeder gate is open, with the striker plate being automatically movable to an inoperative "out of the way" position when the associated bulk flow belt feeder gate is moved to a closed position.

It is a further object of the invention to provide a combination with a bulk flow belt feeder gate used for unloading bulk material from a ship hold or the like onto an underlyng conveyor belt, a cooperating striker plate used for forming the cross-sectional shape of the deposited load on the conveyor belt as the load moves downstream of the given bulk flow feeder gate, to thereby meter the load carried away from a given gate by the conveyor belt, which striker plate is automatically movable into either operative or inoperative position in dependence on the open or closed condition of the associated bulk flow belt feeder gate.

It is a further object of the invention to provide a cooperating bulk flow belt feeder gate and interlocked striker plate which permits use of a plurality of bulk flow belt feeder gates depositing onto a common underlying conveyor belt in a ship unloading arrangement.

In achievement of these objectives, there is provided in accordance with an embodiment of the invention a bulk flow belt feeder gate for discharging a bulk material such as mineral ore or the like from a ship hold or the like onto an unloading conveyor belt beneath the ship hold, and a cooperating striker plate positioned immediately contiguous the downstream end of the bulk flow belt feeder gate and interlocked with the gate, whereby the striker plate is automatically selectively movable into an operative or inoperative position in accordance with whether the bulk flow belt feeder gate is in open or closed position. When in the "down" or operative position corresponding to an open position of the bulk flow belt feeder gate, the striker plate controls the cross-sectional shape of the load of bulk material passing from beneath the associated bulk flow belt feeder gate onto the conveyor belt downstream of the given gate, the striker plate cooperating with the associated bulk flow belt feeder gate to provide what in effect is a material flow metering action which determines the tonnage of bulk material delivered by the belt conveyor per unit time. When in a raised or inoperative position, corresonding to a closed position of the associated bulk flow belt feeder gate, the striker plate is in noninterfering relation with respect to bulk material deposited on the conveyor by another bulk flow belt feeder gate upstream of the given gate.

Further objects and advantages of the invention will become apparent from the following description taken in conjunction with the accompanying drawings in which:

BRIEF DESCRIPTION OF THE DRAWINGS

FIG. 1 is a diagrammatic view, partially in elevation and partially in longitudinal section, of a cargo ship having a hold provided with a plurality of bulk flow belt feeder gates, each having an associated striker plate, the plurality of bulk flow belt feeder gates overlying a common moving conveyor belt onto which bulk material such as mineral ore or the like is dispensed from the individual gates for metering by a striker plate associated with each given gate;

FIG. 3 is a view in longitudinal elevation of one cut-off gate of the pair of cooperating cut-off gates of a given bulk flow belt feeder gate, showing the mechanically interlocked relation of the striker plate to the cut-off gate, with the striker plate being shown in its raised inoperative position, corresponding to a closed condition of the bulk flow belt feeder gate; and FIG. 4 is a detailed view in longitudinal elevation showing one linearally movable cut-off gate, of the pair of cooperating cut-off gates of a given bulk flow belt feeder gate, and showing the mechanical interlock arrangement of the cut-off gate with the associated striker plate, with the striker plate being shown in its lowered operative position corresponding to the open position of the cut-off gate.

DESCRIPTION OF THE PREFERRED EMBODIMENT

Figure 2:
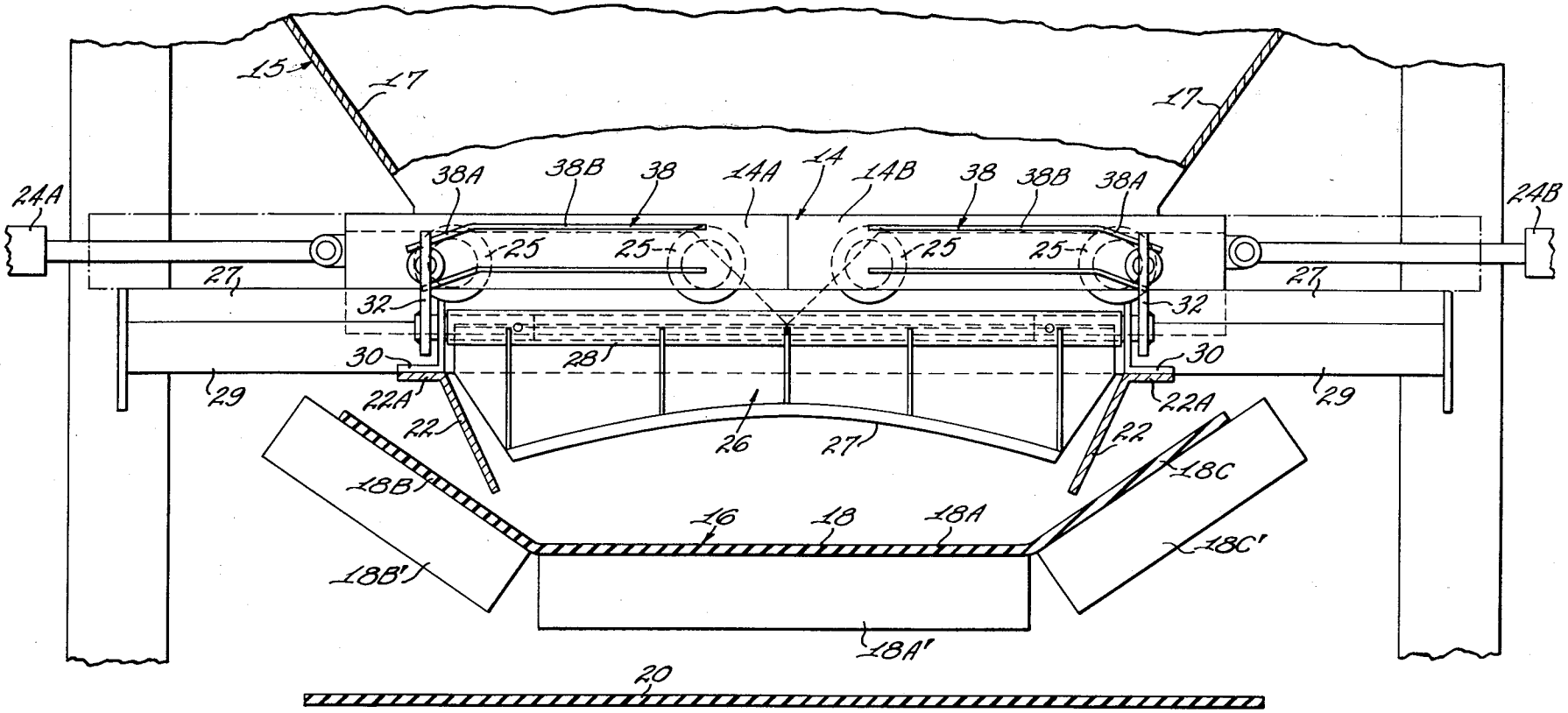
FIG. 2 is a view in transverse cross-section showing a bulk flow belt feeder gate in closed position, and also showing in its retracted inoperative position the striker plate associated with the bulk flow feeder gate.

Referring now to FIG. 1, there is shown a ship generally indicated at 10 of the type adapted for carrying bulk cargo such as mineral ore, coal, etc. The ship includes a hold generally indicated at 12 and shown as extending for a substantial part of the length of the ship. However, the hold 12 shown in FIG. 1 could be subdivided by bulkheads or partitions extending transversely of the longitudinal axis of the ship into a plurality of smaller holds. The hold 12 is filled with a bulk material which may be of a type previously mentioned. If the hold 12 is subdivided by transverse bulkheads or partitions, different types of bulk material may be carried by different sections of the hold. At the lower end of the hold 12 a plurality of bulk flow belt feeder gates each generally indicated at 14 are provided in overlying relation to a conveyor belt generally indicated at 16. The lower end of hold 12 is provided with a separate discharge hopper generally indicated at 15 (FIG. 2) corresponding to each gate 14, the bulk material passing through the respective discharge hoppers 15 to the respective gates 14. The downwardly tapered shape of each discharge hopper 15 is defined by laterally inclined walls 17 (FIG. 2) and by longitudinally inclined walls 19 (FIG. 1).

The conveyor belt includes an upper run 18 which moves in the direction of the arrow, namely, from left to right relative to the view of FIG. 1, and a return run 20. The upper run 18 of conveyor belt 16 is troughed, as best seen in FIG. 2, and includes a horizontal base portion 18A and upwardly inclined opposite side portions 18B and 18C. The horizontal surface portion 18A of the upper run 18 of conveyor belt 16 is supported by troughing rollers 18A' lying in a horizontal plane, and the inclined portions 18B and 18C of the upper run 18 are supported by upwardly inclined troughing rollers 18B' and 18C', respectively, all of which is well known in the art.

A pair of laterally oppositely spaced downwardly and inwardly inclined fixed skirt members each indicated at 22 (FIG. 2) and respectively supported by suitable stationary structure such as transversely extending rail support members 29 extend continuously lengthwise of conveyor 16 for substantially the entire length of conveyor 16. Skirt members 22 extend downwardly from a short distance beneath the level of the lower surface of bulk flow belt feeder gates 14 which will be described more fully hereinafter. The spacing between the oppositely disposed skirt members 22 at the upper ends thereof is approximately equal to the width of the opening of gate 14 at its fully open position, the oppositely disposed skirt members 22 converging downwardly toward each other and being spaced apart at their opposite lower ends by approximately, or just slightly less than, the lateral width of the load of bulk material which passes through striker plate 26, to be described, when striker plate 26 is in its "down" position. The lower end of the continuous skirts 22 have some vertical clearance with respect to the underlying inclined portions 18B and 18C of the upper run 18 of conveyor belt 16 to prevent any interference by the fixed continuous skirts 22 and the underlying but contiguous moving upper run 18 of conveyor belt 16.

The purpose of continuous skirt members 22 is to laterally contain the bulk material flowing from the stock pile in hold 12 through a given open bulk flow belt feeder gate 14 onto upper run 18 of conveyor belt 16 before the material discharged by the given gate has passed through its associated striker plate 26 (to be described).

In the illustrated embodiment, as best seen in FIG. 2, each bulk flow belt feeder gate 14 comprises a pair of cut-off gates 14A and 14B lying in a horizontal plane and movable by a suitably mounted associated hydraulic ram 24A or 24B, respectively, selectively into a closed position (as shown in FIGS. 2 and 3) or into an open position. Each of the cut-off gates 14A, 14B carries wheels 25 which move upon track members 27 (FIGS. 2, 3 and 4) during the opening or closing movement of a given gate 14A or 14B.

The control systems of the hydraulic rams 24A and 24B are so coordinated that the two gates 14A, 14B move in synchronism either in an opening direction or in a closing direction, as required.

The cut-of gates 14A, 14B of each bulk flow belt feeder gate 14 are movable in a horizontal plane in a direction laterally of the longitudinal direction of movement of conveyor belt 16.

In accordance with an important feature of the invention, a striker plate (sometimes known as a "shear" plate) generally indicated at 26 is located contiguous the downstream end of each bulk flow belt feeder gate 14 and is movable about a horizontal axis for a limited angle from a retracted inoperative position corresponding to a closed position of the bulk flow feeder gate 14 (see FIGS. 2 and 3) to a "down" operative position (FIG. 4), corresponding to an open position of the bulk flow belt feeder gate 14. In its "down" operative position, the striker plate 26 due to the shape and location of the lower concave edge 27 thereof automatically determines the cross-section of the load of bulk material which is conveyed downstream of the corresponding open bulk flow feeder gate 14, thereby providing a metering action on the bulk flow material dragged along the conveyor from the associated open gate 14, to thereby determine the tonnage of the bulk flow material carried by the conveyor per unit time. Striker plate 26 is bounded on its opposite lateral inclined edges by the oppositely disposed continuous skirts 22, a suitable clearance being provided between skirts 22 and the lateral edges of striker plate 26.

A mechanical interlock arrangement is provided between the cut-off gates 14A, 14B of each bulk flow feeder gate 14 and the associated striker plate 26 which automatically causes the striker plate 26 to be moved to a retracted "out of the way" position when the gates 14A and 14B of a given bulk flow belt feeder gate are in the closed position as seen in FIGS. 2 and 3, and with the mechanical interlock arrangement automatically causing the striker plate 26 to move down to an operative position in which it determines the cross-sectional contour of the load material on the conveyor belt when the gates 14A and 14B are moved to an open position (FIG. 4). A given pair of cut-off gates 14A and 14B are interlocked with the same striker plate 26.

Referring now to FIGS. 2, 3 and 4, it will be seen that the striker plate 26 is secured to and pivotally moves with a horizontal shaft 28, the opposite ends of shaft 28 contiguous opposite lateral sides of striker plate 26, being supported for a limited pivotal movement by bearing bracket members 30 which in turn are supported by suitable stationary structure, such as flange 22A on the upper end of each skirt member 22. Each of the opposite ends of shaft 28 has fixed thereto a lever 32 which carries contiguous the upper end thereof stub shaft 34, shaft 34 projecting laterally from the upper portion of lever 32 and in a generally upstream direction relative to the direction of movement of the conveyor. Stub shaft 34 carries contiguous the upstream end thereof a cam roller member 36 which rides in a cam track generally indicated at 38 which projects from the downstream side of each respective gate 14A or 14B as the case may be. As best seen in FIG. 2, the cam track 38 on each gate 14A, 14B includes a relatively short downwardly inclined portion indicated at 38A located at the laterally outermost portion of the respective track 38, with the laterally innermost portion of inclined track portion 38A merging into and communicating with the generally horizontal track portion indicated at 38B which lies at a higher level than the downwardly inclined cam track portion 38A.

When each of the gates 14A, 14B are in the closed position corresponding to views shown in FIGS. 2 and 3, each cam roller 36 will lie at the laterally outermost portion and lowermost portion of inclined cam track porton 38A, causing cam roller 36 to move to the upstream end of (i.e. — to the left as shown in FIG. 3) of the cam slot 38 carried by each respective gate 14A, 14B. When each cam roller 36 is in the lower end 38A of cam slot 38, corresponding to a closed position of gates 14A, 14B, the lever arm 32 which carries cam roller 36, will be caused to move in a counterclockwise direction to the position shown in FIG. 3 thereby swinging striker plate 26 to an upwardly retracted position in which the given striker plate 26 will not interfere with bulk material moving along the belt conveyor from an open bulk flow belt feeder gate which is upstream of the closed bulk flow belt feeder gate 14 under discussion.

If the cut-off gates 14A, 14B of a given bulk flow belt feeder gate 14 are moved to open position by their corresponding operating rams 24A and 24B which move the attached cut-off gates 14A, 14B to a completely retracted position, initial movement of each gate 14A and 14B toward its open position will cause the corresponding cam roller 36 associated with each of the respective cut-off gates to move into the flat horizontal and more elevated cam track portion 38B carried by each of the respective cut-off gates 14A, 14B. Movement of the cam roller 36 into the elevated horizontal portion 38B of cam track 38 will cause the respective cam roller 36 to move into the downstream portion of the corresponding cam slot 38, as seen in FIG. 4, accompanied by a clockwise movement relative to the view of FIG. 4 of lever arm 32 which carries cam roller 36. The clockwise movement of lever arm 32 will cause striker plate 26 which is fixed to shaft 28, to move pivotally downwardly to an operative position as seen in FIG. 4 in which striker plate 26 serves to determine the cross-sectional contour of the bulk material dragged along the upper run 18 of conveyor belt 16 from the downstream side of the corresponding bulk flow belt feeder gate 14, striker plate 26 thereby providing a metering action on the flow of bulk material which flows downstream from the corresponding bulk flow belt feeder gate 14. If cut-off gates 14A, 14B are moved to a closed position from an open position, a reverse action to that just described occurs. Cam roller 36 moves from horizontal cam track portion 38B to the laterally outermost end of inclined cam track portion 38A, causing a counterclockwise (as viewed in FIGS. 3 and 4) upward pivotal swinging movement of striker plate 26 to the retracted position shown in FIG. 4.

In using the terms "upstream" and "downstream" in describing cam slot 38, these terms are relative to the direction of movement of the upper run 18 of conveyor 16.

SUMMARY OF OPERATION

When the cut-off gates 14A, 14B of a given bulk flow belt feeder gate 14 are in closed position as seen in FIGS. 2 and 3, the cam roller 36 carried by lever arm 32 secured to shaft 28 which carries the associated striker plate 26, is at the lowermost end of inclined cam track portion 38A of cam track 38 carried by the respective gate 14A or 14B. When the cam roller 36 is in this position, striker plate 26 is maintained in a raised "out of the way" position in which it does not interfere with load material discharged onto the conveyor belt upstream of the closed gate 14.

When the cut-off gates 14A, 14B, of a given bulk flow belt feeder gate 14 begin to move toward an open position, cam roller 36 moves to the upper horizontal portion 38B of cam track 38 associated with the respective gates 14A and 14B, as seen in FIG. 4, causing movement of striker plate 26 to a "down" operative position in which it determines the cross-sectional contour of the flow of bulk material dragged along the upper run 18 of conveyor belt 16 downstream of the given open bulk flow belt feeder gate 14.

When a given bulk flow belt feeder gate 14 is in an open position, bulk material discharges from hold 12 in a substantially uncontrolled manner through the associated hopper 15 and the associated open gate 14 onto the underlying conveyor belt 16, the material so deposited being laterally confined by the oppositely disposed continuous skirts 22, and the striker plate 26 which is in its down or operative position when the gate 14 is open serves to meter the downstream flow of material which has been deposited by the associated gate 14 on the upstream side of the associated striker plate 26.

Thus, there has been provided in accordance with the invention an arrangement in which a bulk flow belt feeder gate has associated with it a striker plate lying contiguous the downstream end of the given bulk flow belt feeder gate, with the position of the associated striker plate being coordinated with the open or closed position of the given bulk flow feeder gate in such manner that when the gate is closed the associated striker plate is raised upwardly into an "out-of-the-way" retracted position in which it does not interfere with material deposited onto the conveyor belt by other bulk flow belt feeder gates lying upstream of the given gate; and in which the associated striker plate is automatically moved downwardly to an operative position in which it serves to determine the cross-section of the load dragged along the conveyor belt downstream of the open gate, thereby providing a metering action which determines the tonnage of the bulk flow material delivered by the conveyor.

The interlock arrangement between the bulk flow belt feeder gate and the striker plate hereinbefore described permits a plurality of bulk flow belt feeder gates each having an associated striker plate to be located in discharge relation to a common underlying conveyor, as seen in FIG. 1 of the drawings, with only one bulk flow belt feeder gate being open to discharge material to the common conveyor belt at any particular time.

From the foregong detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In combination, a bulk flow belt feeder gate for discharging a bulk material from a ship hold or the like onto an unloading conveyor belt positioned in underlying relation to said feeder gate, a striker plate positioned contiguous the downstream end of said feeder gate relative to the direction of movement of said conveyor belt, and means interlocking the position of said striker plate with the position of said gate, whereby said striker plate is moved to a retracted position away from said conveyor belt when said gate is closed, and whereby said striker plate is moved to an operative position in which it meters bulk material flow from said gate onto the portion of said conveyor belt lying downstream of said gate when said gate is open.

2. The combination defined in claim 1 in which said unloading conveyor belt runs in a direction substantially parallel to the longitudinal axis of the ship.

3. The combination defined in claim 1 comprising a plurality of bulk flow belt feeder gates, each gate having associated in interlocked relation therewith a corresponding striker plate, and a common unloading conveyor belt movable in underlying relation to said plurality of bulk flow belt feeder gates, said plurality of gates being spaced from each other lengthwise of the direction of travel of said underlying conveyor belt whereby to define a plurality of conveyor feed points spaced from each other longitudinally of said conveyor.

4. The combination defined in claim 1 in which said striker plate is mounted for a predetermined pivotal angular movement about a substantially horizontal axis.

5. The combination defined in claim 1 in which said bulk flow belt feeder gate comprises two cooperating cut-off gates movable in opposite directions toward and into abutting relation with each other to close said bulk flow belt feeder gate, said two cooperating cut-off gates being movable in opposite directions away from each other to open said bulk flow belt feeder gate.

6. The combination defined in claim 5 in which said cut-off gates are mounted for movement in a substantially horizontal plane.

7. The combination defined in claim 5 in which said cut-off gates are mounted for movement in a direction laterally of the longitudinal direction of movement of said conveyor belt.

8. The combination defined in claim 1 including power means for selectively moving said gates into a closed or an open position.

9. The combination defined in claim 1 in which said bulk flow belt feeder gate and said striker plate define a pair of cooperating interlocked means, cam track means carried by one of said interlocked means, cam means carried by the other of said interlocked means, said cam means being engageable with said cam track means, whereby to interlock the position of said striker plate with the position of said gate.

10. The combination as defined in claim 9 in which said cam track means is carried by said bulk flow belt feeder gate and said cam means is carried by said striker plate.

11. The combination defined in claim 5 in which each cutt-off gate carries a cam track means, and separate cam means carried by said striker plate in laterally spaced relation to each other, each respective cam means being engageable with a cam track means carried by a corresponding different one of said cut-off gates, whereby to interlock the position of said striker plate with the position of said cut-off gates.

12. In combination, a bulk flow belt feeder gate for discharging a bulk material from a ship hold or the like onto an unloading conveyor belt positioned in underlying relation to said feeder gate, said bulk flow belt feeder gate comprising two cooperating cut-off gates movable in opposite directions toward and into abutting relation with each other to close said bulk flow belt feeder gate, said two cooperating cut-off gates being movable in opposite directions away from each other to open said bulk flow belt feeder gate, a striker plate positioned contiguous the downstream end of said cut-off gates relative to the direction of movement of said conveyor belt, and means interlocking the position of said striker plate with the position of said cut-off gates, whereby said striker plate is moved to a retracted position away from said conveyor belt when said cut-off gates are closed, and whereby said striker plate is moved to an operative position in which it meters bulk material flow from said bulk flow belt feeder gate onto the portion of said conveyor belt lying downstream of said bulk flow belt feeder gate when said bulk flow belt feeder gate is open.

13. The combination defined in claim 12 in which said unloading conveyor belt runs in a direction substantially parallel to the longitudinal axis of the ship.

14. The combination defined in claim 12 in which said cut-off gates are mounted for movement in a direction laterally of the longitudinal direction of movement of said conveyor belt.

15. The combination defined in claim 12 in which said cut-off gates are mounted for movement in a substantially horizontal plane.

16. The combination defined in claim 12 in which said striker plate is mounted for a predetermined pivotal angular movement about a substantially horizontal axis.

17. The combination defined in claim 12 in which said two cooperating cut-off gates define a first interlocked means, and said striker plate defines a second interlocked means, cam track means carried by one of said interlocked means, cam means carried by the other of said interlocked means, said cam means being engageable with said cam track means, whereby to interlock the position of said striker plate with the position of said cut-off gates.

18. The combination defined in claim 17 in which said cam track means is carried by said cut-off gates, and said cam means is carried by said striker plate.

* * * * *